US005871296A

United States Patent [19]

Furukawa et al.

[11] Patent Number: 5,871,296

[45] Date of Patent: Feb. 16, 1999

[54] CLICKING-TYPE WRITING IMPLEMENT

[75] Inventors: Kazuhiko Furukawa; Hiroaki Koyama, both of Kanagawa, Japan

[73] Assignee: Mitsubishi Pencil Kabushiki Kaisha, Tokyo, Japan

[21] Appl. No.: 696,352

[22] Filed: Aug. 13, 1996

[30] Foreign Application Priority Data

| | | | |
|---|---|---|---|
| Oct. 3, 1995 | [JP] | Japan | 7-278251 |
| Oct. 24, 1995 | [JP] | Japan | 7-298822 |
| Oct. 24, 1995 | [JP] | Japan | 7-298823 |
| Oct. 24, 1995 | [JP] | Japan | 7-298824 |
| Jun. 3, 1996 | [JP] | Japan | 8-160443 |

[51] Int. Cl.[6] ..... B43K 7/12; B43K 24/00

[52] U.S. Cl. ..... 401/106; 401/110; 401/214; 401/219

[58] Field of Search ..... 401/104, 105, 401/106, 109, 214, 219, 110, 111, 112

[56] References Cited

U.S. PATENT DOCUMENTS

| | | | |
|---|---|---|---|
| 3,326,189 | 6/1967 | Baer | 401/105 |
| 3,637,316 | 1/1972 | Bross | 401/104 |
| 3,810,701 | 5/1974 | Freccero et al. | 401/110 |
| 3,819,282 | 6/1974 | Schultz | 401/105 |
| 4,991,988 | 2/1991 | Snell et al. | 401/111 |
| 4,995,750 | 2/1991 | Akita . | |
| 5,413,428 | 5/1995 | Kageyama | 401/111 X |

FOREIGN PATENT DOCUMENTS

| | | | |
|---|---|---|---|
| 2566708 | 1/1986 | France | B43K 24/04 |
| 1108589 | 7/1956 | Germany | 401/110 |
| 1263546 | 3/1968 | Germany | 401/110 |
| 3312770 | 10/1984 | Germany | 401/104 |
| Sho 58-117982 | 8/1983 | Japan . | |
| Sho 60-183199 | 9/1985 | Japan . | |
| Hei 7-37689 | 7/1995 | Japan . | |
| 395791 | 1/1966 | Switzerland | 401/111 |
| 712653 | 7/1954 | United Kingdom | 401/111 |

*Primary Examiner*—Steven A. Bratlie
*Attorney, Agent, or Firm*—Darby & Darby

[57] ABSTRACT

A clicking-type writing implement includes a writing element having a writing portion at its distal end, a spring for urging the writing element toward the end, and a clicking rod loosely fitted interlocked with the writing element so as to project from a barrel cylinder. Upon depression of the clicking rod, the engaging rib of a rotor in the barrel cylinder and the engaging bead in the inner cylinder engage with each other, so that the writing element projects and stays projected from a front portion of the barrel cylinder. This clicking-type writing implement also has a so-called double clicking mechanism and a safety mechanism. According to the double clicking mechanism, the clicking rod is projected upon depression and is retracted upon further depression. According to the safety mechanism, when the engaging bead and the engaging rib engage with each other, the projecting state of the writing portion of the writing element is maintained, and when the engaging bead is lifted, the writing element is retracted. No cam surfaces are formed on the inner surface of the barrel cylinder. In the inner cylinder, a cam is formed on the front edge of a cylindrical portion inserted and fixed in the barrel cylinder.

9 Claims, 16 Drawing Sheets

DEVELOPMENT OF OUTER SIDE SURFACE OF CYLINDRICAL CAM

DEVELOPMENT OF INNER GROOVE PORTION

CLICKING-TYPE WRITING IMPLEMENT

FIELD OF THE INVENTION

The present invention relates to a clicking-type writing implement which performs writing by projecting a writing element upon depressing a clicking rod at the rear end. The writing implement has an improved safety mechanism so that when storing the clicking-type writing implement in the pocket, the inner cylinder and the engaging portion in the barrel cylinder disengage from each to retract the writing element, so that the user's clothes will not be stained. More specifically, the present invention relates to improvements in reliability in operation and operability of a clicking-type writing implement when it is formed with an inexpensive arrangement, and further to an improvement in a clicking-type ball-point pen which can be made thin even when a slightly thick writing element is loaded, so that the outer appearance is improved and the reliability in operation and operability are improved when the clicking-type ball-point pen is formed with an inexpensive arrangement.

DESCRIPTION OF THE PRIOR ART

In a conventional double clicking-type writing implement in which the writing element may be repeatedly projected and retracted by depressing a clicking rod, and in which the writing implement has a good operability and provides an improved operational feel, a writing implement having a safety mechanism has been sought. Such a writing implement has not been available as the shaft diameter is increased or the operation tends to be unstable. In a cap-less clicking-type ball-point pen, in which the necessity of attaching and detaching a cap is eliminated, a hole is formed in the front end face of the barrel cylinder, and the writing element is projected, by depressing a clicking rod, to permit writing. If the user forgets to retract the writing element before storing the ball-point pen in a pocket, the writing element stays projected outside the barrel cylinder, thus accidentally staining the pocket with ink. In order to solve this problem, it has been proposed that an engaging bead on the clip and a projection from the shaft engage each other, so that when the user puts the writing implement in a pocket, the writing element is automatically retracted. In another proposed device, a window formed in the barrel cylinder and an engaging portion on the bead portion of the clip are provided, such that when the user puts the writing implement in the pocket, the writing element is reliably retracted in the same manner as described above. In these proposals, however, machining is required to form the metal clip with the window and the engaging portion, leading to a high cost and a poor machinability. Also, the endurance of the spring properties of the clip may be sacrificed, or the number of components may be increased. In particular, in the known safety mechanism which prevents clothes from being stained due to the clicking motion, when the writing element is to be retracted from a projection position, the engagement is canceled by lifting the clip bead portion in response to depression of the rear end side of the clip, so that the writing element is retracted. In this case, however, since strong spring properties are imparted to the corresponding portion of the clip to improve endurance against repeated engagement and disengagement, a certain force is required for disengagement, making it difficult to set a writing implement load that is easy to use. In particular, when a direct-supply writing element is loaded, the ink in the writing element may shift or leak, or air may be trapped in the distal end portion of the ink due to an impact applied to the writing element during disengagement, thus causing ink starving. For these reasons, the writing element requires an impact-resistant mechanism.

SUMMARY OF THE INVENTION

The present invention mainly aims at improving a popular ball-point pen, so that the user's clothes will not be accidentally stained with ink when storing the ball-point pen in the pocket, without interfering with the smooth projecting and retracting operations of the writing element, or writing. At the same time, it is also desirable that a mechanism that facilitates projection and retraction of the writing element have inexpensive components and arrangement, so that the component cost as well as the assembly cost are improved, and the outer appearance is improved. The present invention provides a clicking-type writing implement which ensures reliable operation with low spring force properties that will not easily cause creeping even if the clip is made of a resin, thus guaranteeing a reliable operation with an improved operational feel, while decreasing the clicking impact applied to the writing element.

According to the first aspect of the present invention, there is provided a clicking-type writing implement comprising a writing element having a writing portion at a distal end thereof, a spring for urging the writing element toward the end, a clicking rod loosely fitted and interlocked with the writing element so as to project from a rear end of a barrel cylinder, and a double clicking mechanism with which, upon depression of the clicking rod, the writing element projects and stays projected from a front portion of the barrel cylinder, and upon further depression of the clicking rod, engagement is canceled so that the writing element is retracted. The clicking mechanism is characterized in that a cam is formed at a front edge of a cylindrical portion of an inner cylinder which is inserted and fixed in the barrel cylinder. No cam surfaces are formed on an inner surface of the barrel cylinder. A rotor has a cam projection that moves or rotates together with the cam of the inner cylinder, thereby projecting and retracting the writing element.

The second aspect of the present invention is directed to the clicking-type writing implement according to the first aspect of the present invention. A safety mechanism is constituted in which, when an engaging bead of the inner cylinder and an engaging rib interlocked with the clicking rod in the barrel cylinder engage with each other, the projecting state of the writing portion of the writing element is maintained. When the engaging bead is lifted, the writing element is retracted. The rotor integrally having an engaging rib is rotatable for a predetermined angle in one direction by repeatedly performing clicking. The rotor rotates in a direction of rotation caused by a clicking rod cam of the clicking rod and a clicking cam of the rotor when the writing portion of the writing element is to be projected. The direction of rotation is the same as a direction of rotation caused by a cam projection of the rotor and the cam of the inner cylinder when the writing element is to be retracted.

The third aspect of the present invention is directed to the clicking-type writing implement according to the second aspect of the present invention. In the third aspect, the respective cams are arranged such that a cam surface of the cam of the inner cylinder is formed with a step not engageable with the cam projection.

The fourth aspect of the present invention is directed to the clicking-type writing implement according to the third aspect of the present invention. In the fourth aspect, the cam of the inner cylinder and the clicking rod cam are arranged so as to each have a cam surface as a combination of an acute-angle surface and an obtuse-angle surface.

The fifth aspect of the present invention is directed to the clicking-type writing implement according to any one of the first to fourth aspects of the present invention. In the fifth aspect, a safety mechanism is provided. A clip portion is integrally formed with the inner cylinder and is flexible outward of the barrel cylinder in a radial direction. The rotor interlocks with the clicking rod in the shaft to rotate. The engaging bead in front of the clip portion engages the engaging rib of the rotor to maintain the projecting state of the writing portion of the writing element. When the engaging bead is lifted, the writing element is retracted. The cam projection of the rotor does not engage with the cam of the inner cylinder while the writing element projects.

The sixth aspect of the present invention is directed to the clicking-type writing implement according to any one of the first to fourth aspects of the present invention. The projection of the inner cylinder engages with a stopper groove of the barrel cylinder to regulate a backward movement of the writing element, the inner cylinder, and the rotor.

The seventh aspect of the present invention is directed to the clicking-type writing implement according to any one of the first to fourth aspects of the present invention. The inner cylinder is integrally formed with a projection having a beam portion flexible in a radial direction, the projection being regulated from longitudinally moving in an axial direction and being fixed upon engagement with the stopper groove of the barrel cylinder. An upright portion serving as a rotation stopper of the inner cylinder is inserted in the guide groove of the barrel cylinder.

The eighth aspect of the present invention is directed to the clicking-type writing implement according to any one of the first to fourth aspects of the present invention. The engaging rib of the rotor does not projection exceeding an outer diameter of the barrel cylinder. The engaging bead of the inner cylinder is retracted in the barrel cylinder, and the engaging bead and a window of the barrel cylinder are respectively formed with a bead flat portion and a shaft flat portion.

The ninth aspect of the present invention is directed to the clicking-type writing implement according to any one of the first to fourth aspects of the present invention. The barrel cylinder is made of a transparent resin so that the cam surface of the inner cylinder and the rotor are visually recognizable from outside.

DESCRIPTION OF THE PREFERRED EMBODIMENTS

Figure 1A:
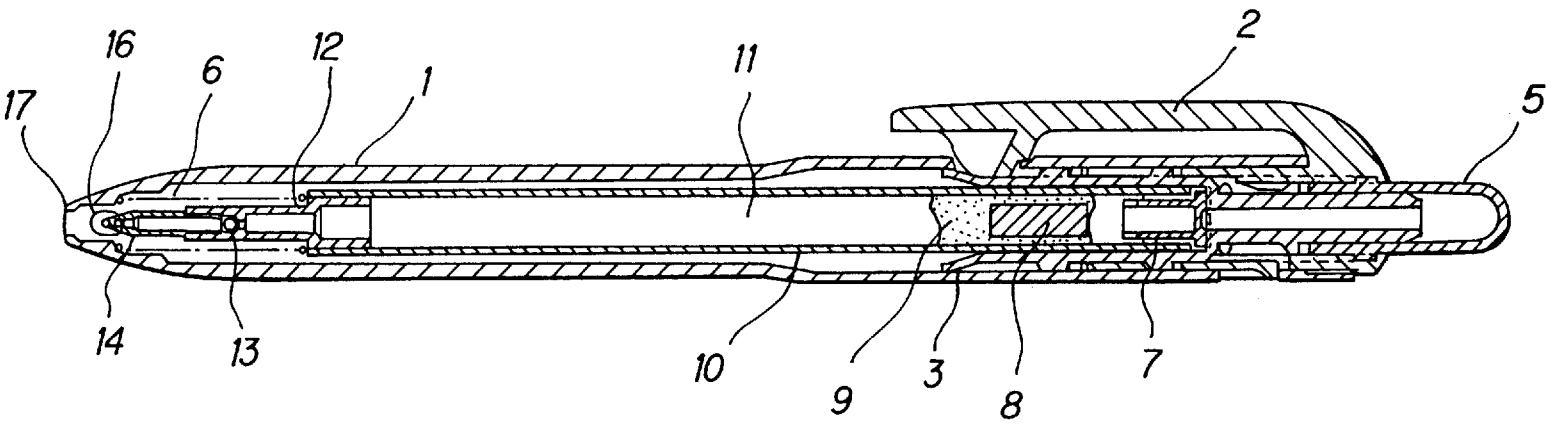
FIG. 1A is a longitudinal sectional view showing the overall arrangement of a writing implement according to one embodiment of the present invention.
Figure 1B:
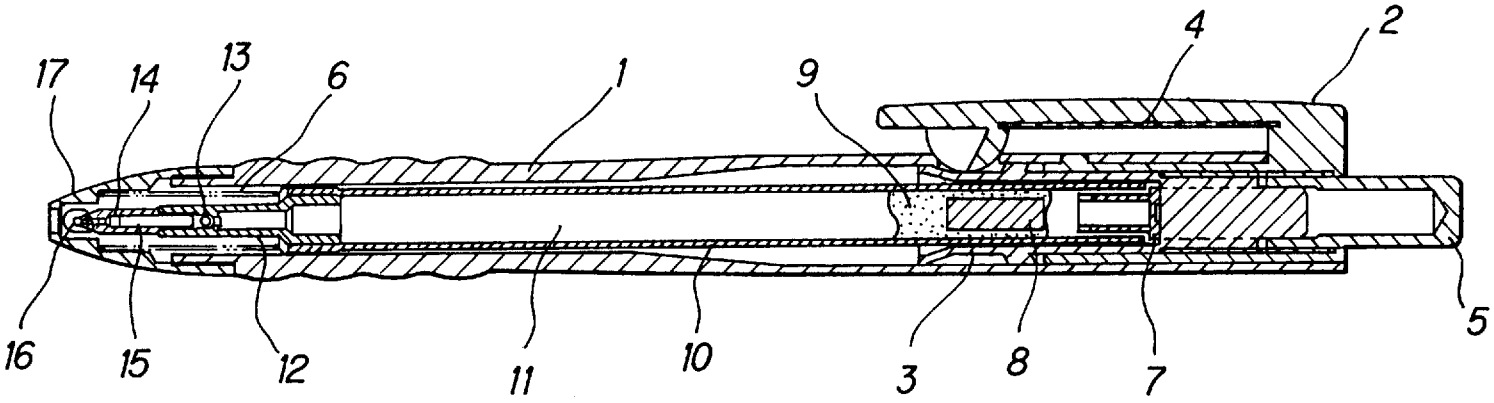
FIG. 1B is a longitudinal sectional view showing the overall arrangement of a writing implement according to another embodiment of the present invention.
Figure 2A:
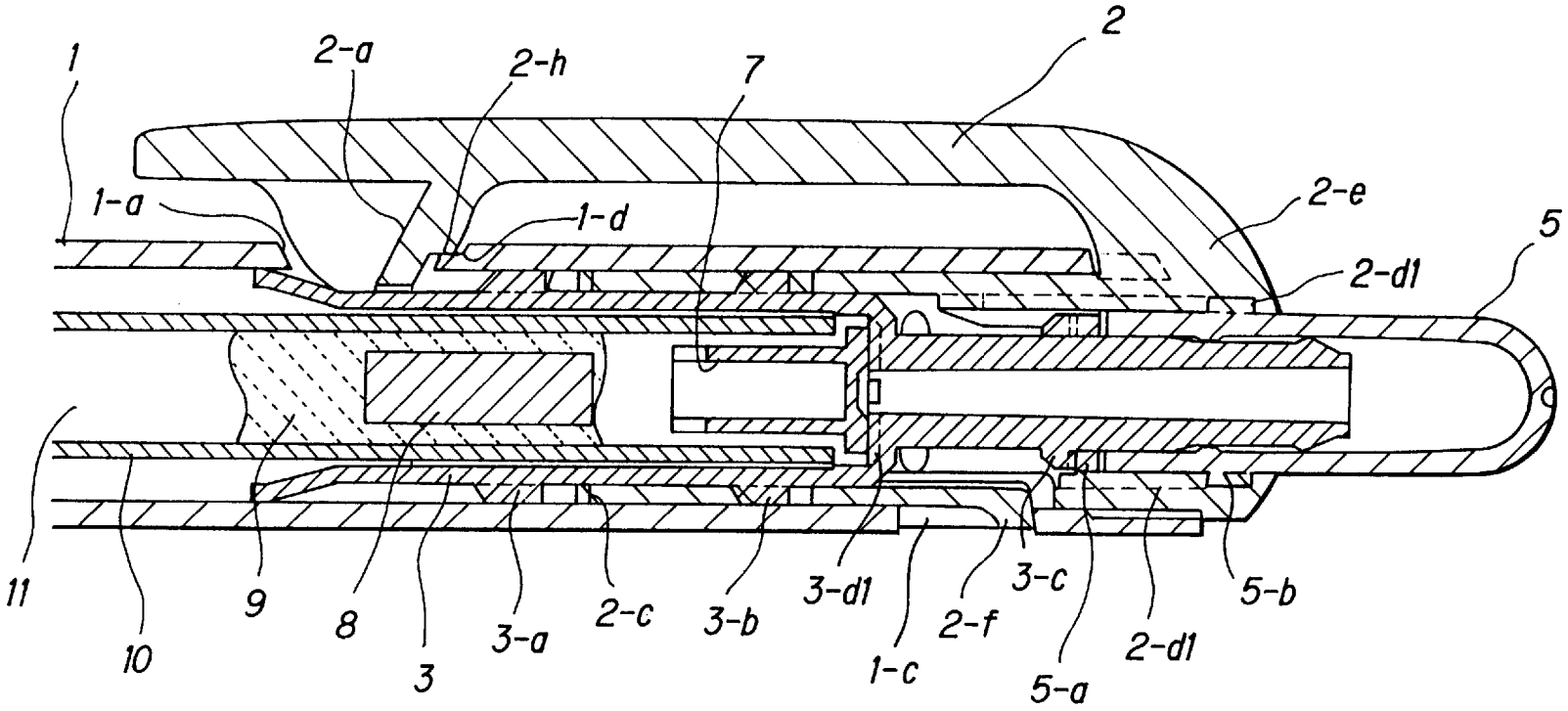
FIG. 2A is a longitudinal sectional view showing the rear end portion of the writing implement shown in FIG. 1A.
Figure 2B:
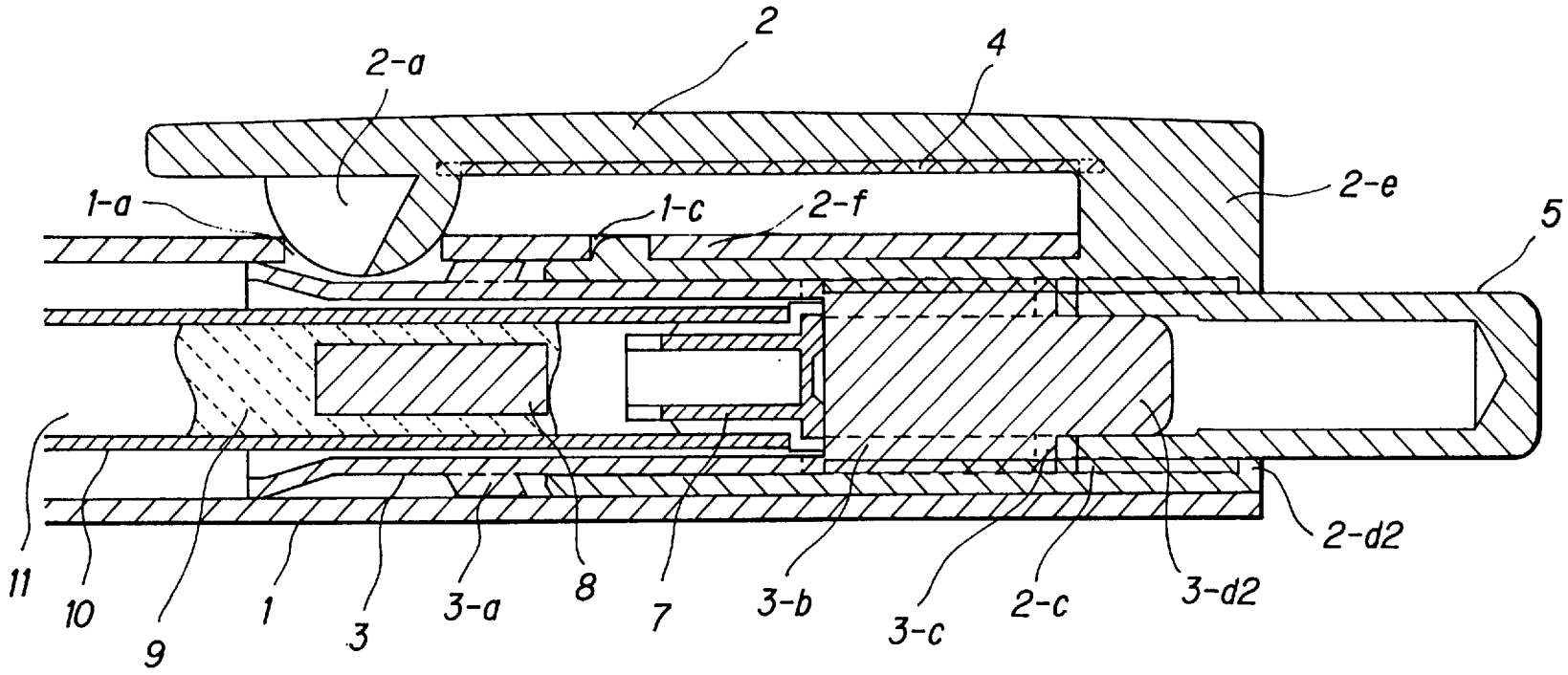
FIG. 2B is a longitudinal sectional view showing the rear end portion of the writing implement shown in FIG. 1B.
Figure 3A:
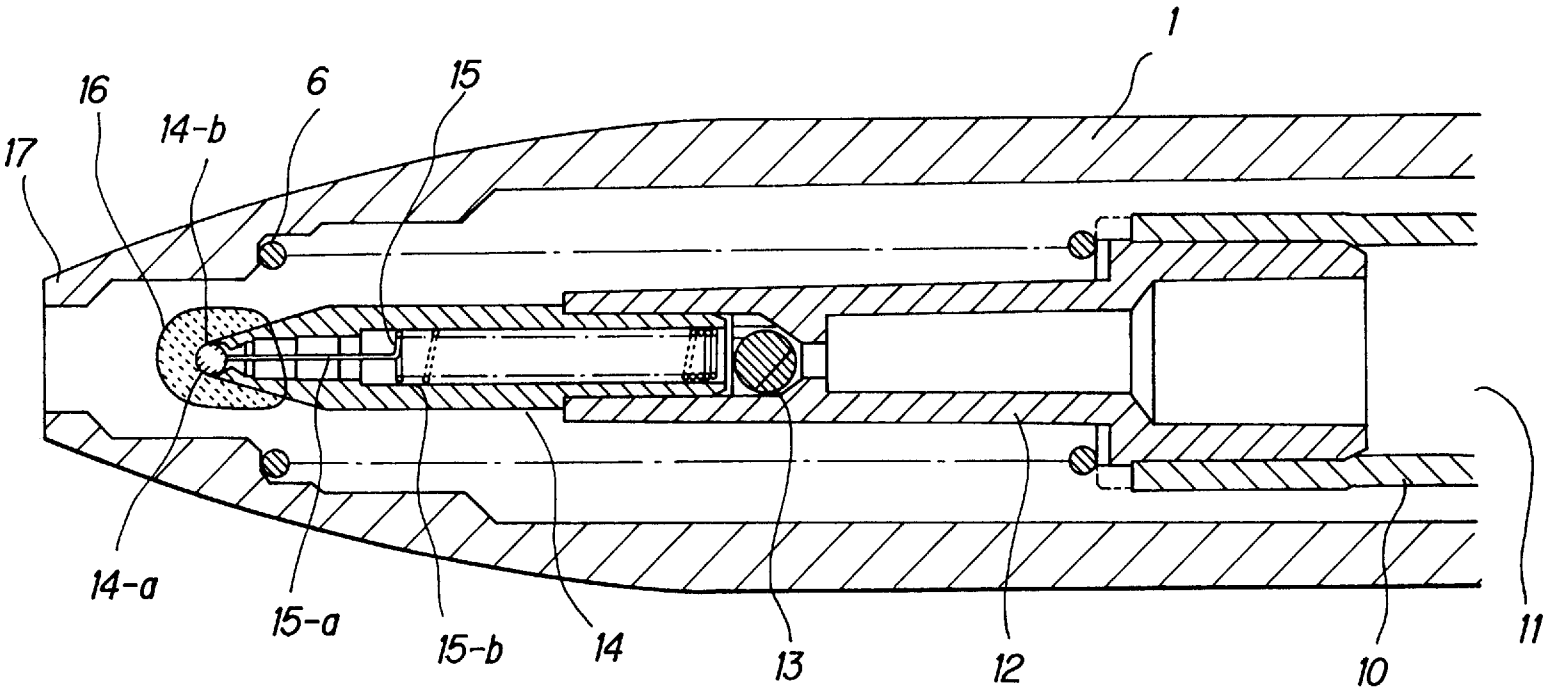
FIG. 3A is a longitudinal sectional view showing the distal end portion of the writing implement shown in FIG. 1A.
Figure 3B:
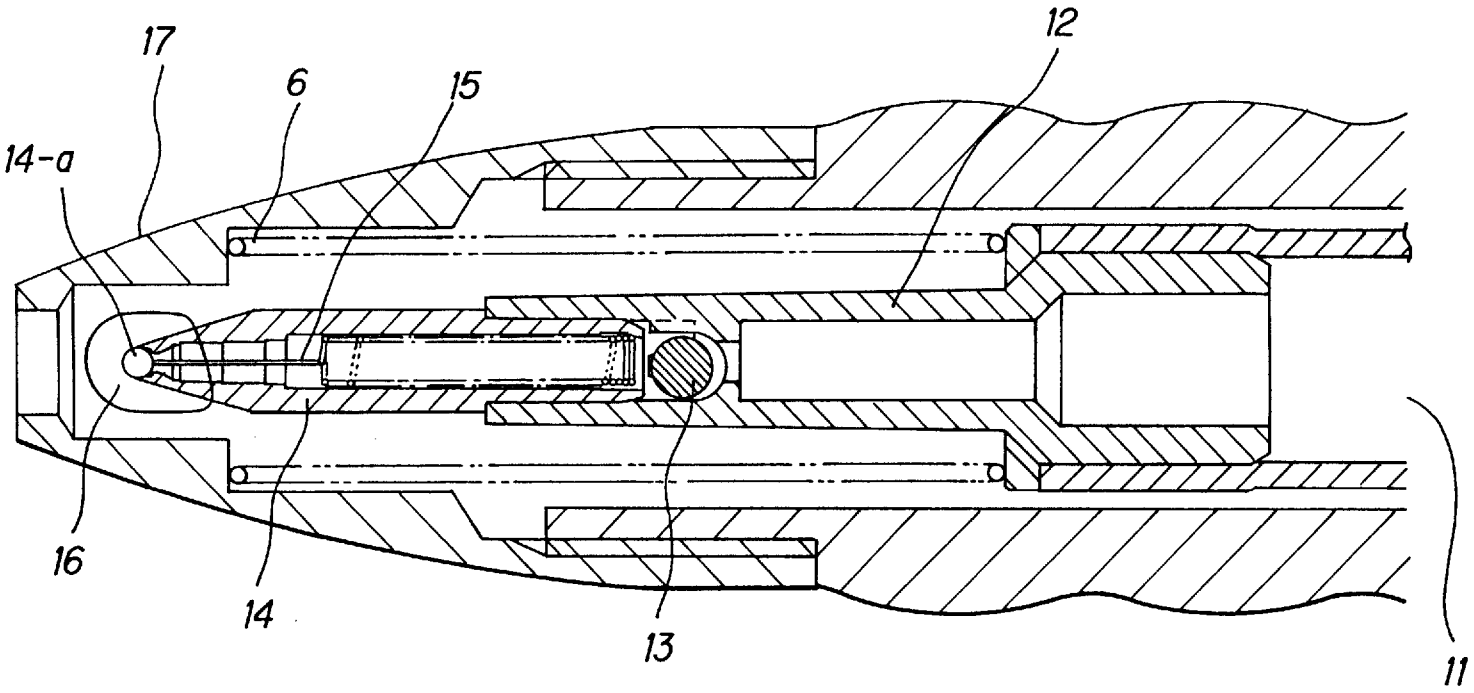
FIG. 3B is a longitudinal sectional view showing the distal end portion of the writing implement shown in FIG. 1B.
Figure 4:
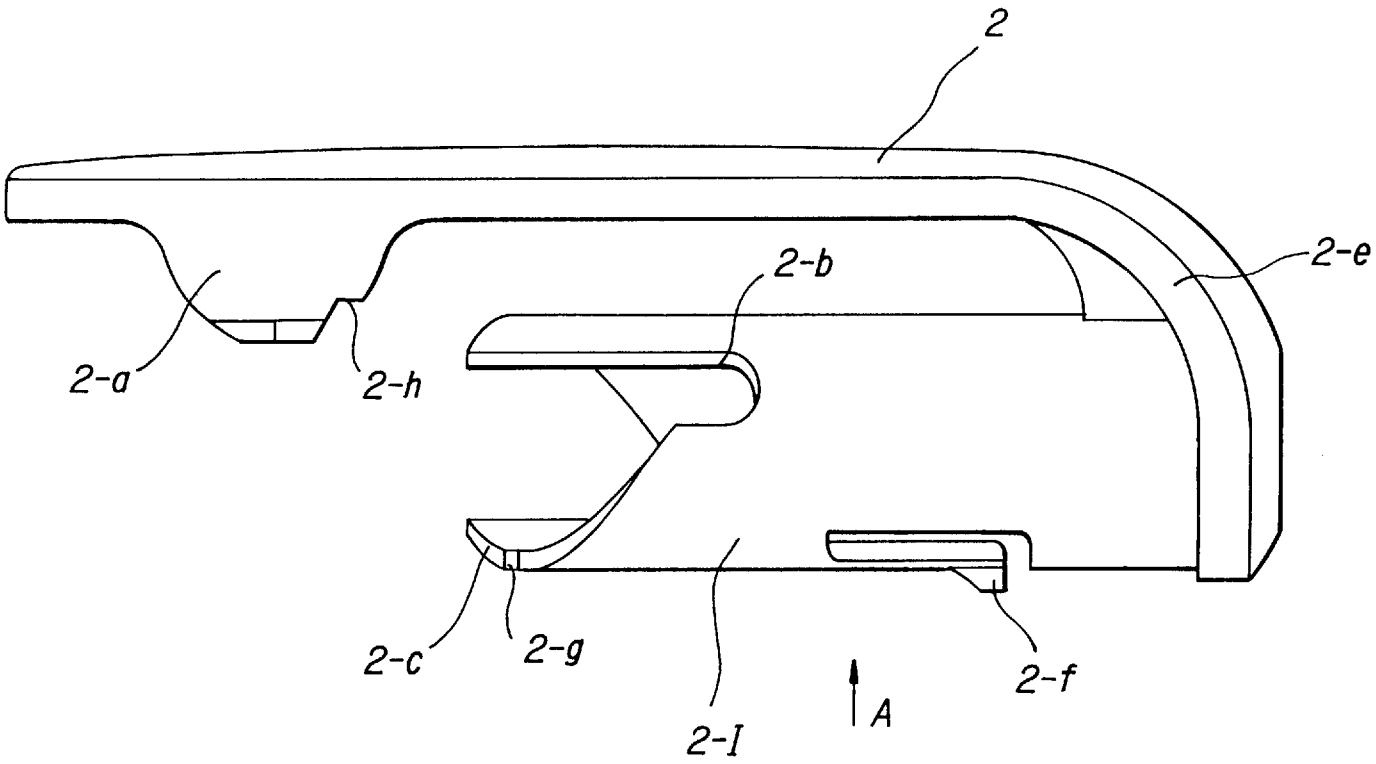
FIG. 4 shows the outer appearance of the components in the cylinder of the writing implement shown in FIG. 1A.
Figure 5:
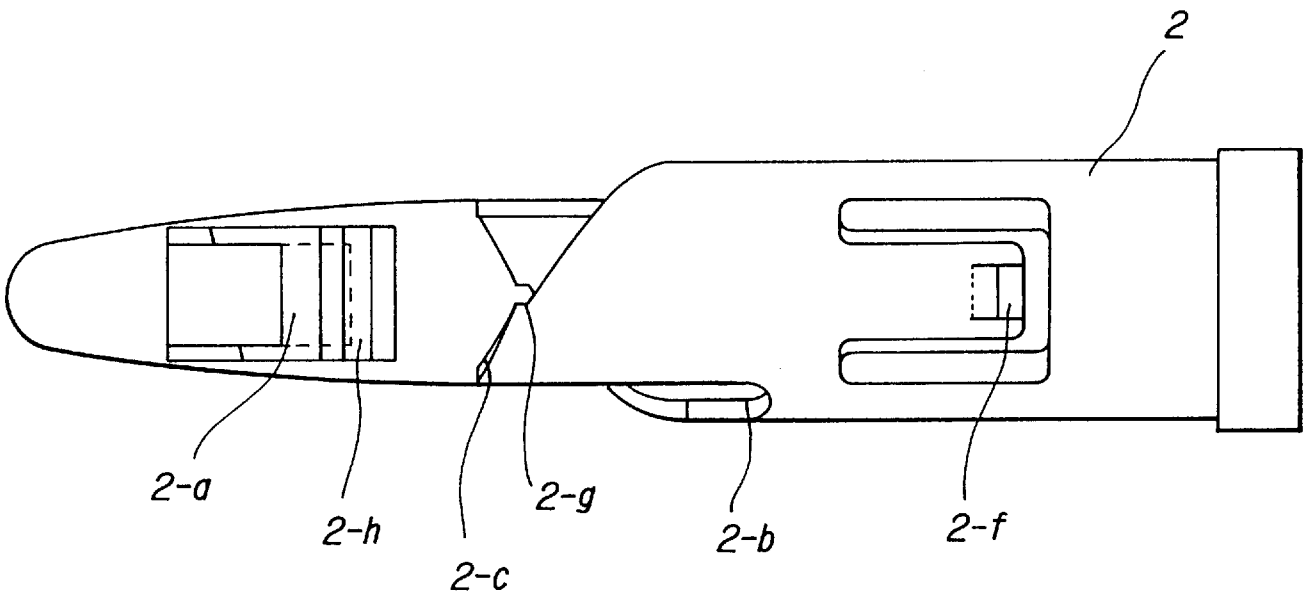
FIG. 5 shows the outer appearance of the components in the cylinder of the writing implement shown in FIG. 1A from below (from a direction indicated by an arrow A)
Figure 6B:
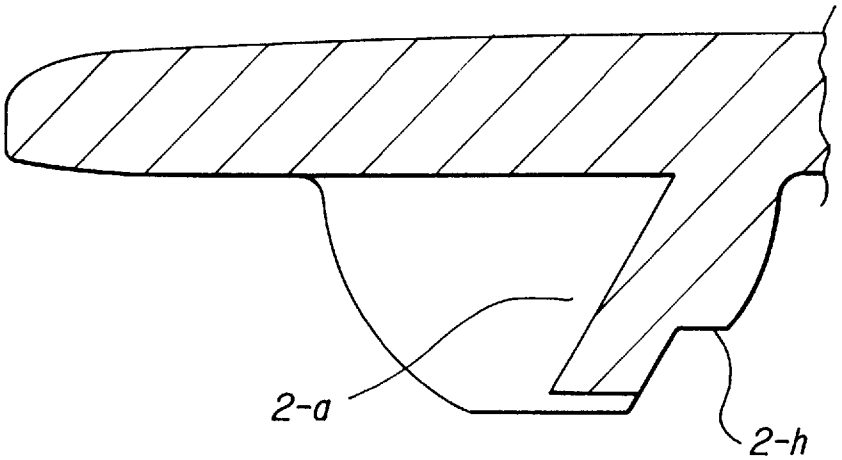
FIGS. 6A and 6B show in detail the outer appearance of the components (engaging bead portion) of the cylinder of the writing implement shown in FIG. 1A.
Figure 6A:
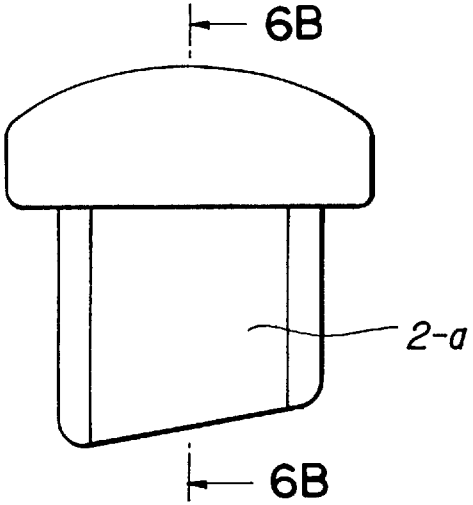
Figure 7:
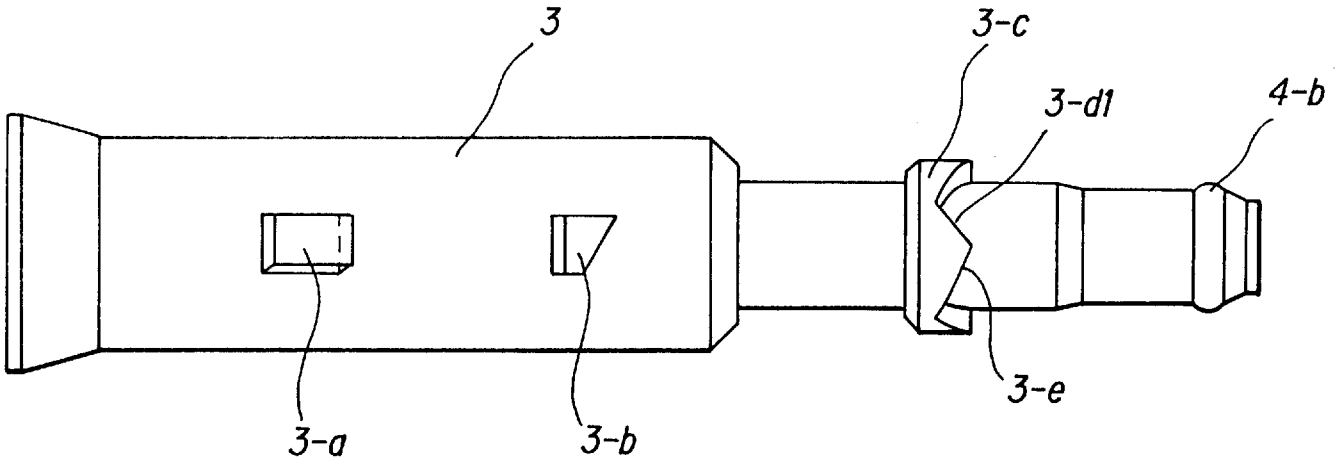
FIG. 7 shows the outer appearance of the rotor of the writing implement shown in FIG. 1A, FIGS. 8A and 8B include schematic developments of the cam inclined surface of the writing implement shown in FIG. 1A.
Figure 8A:
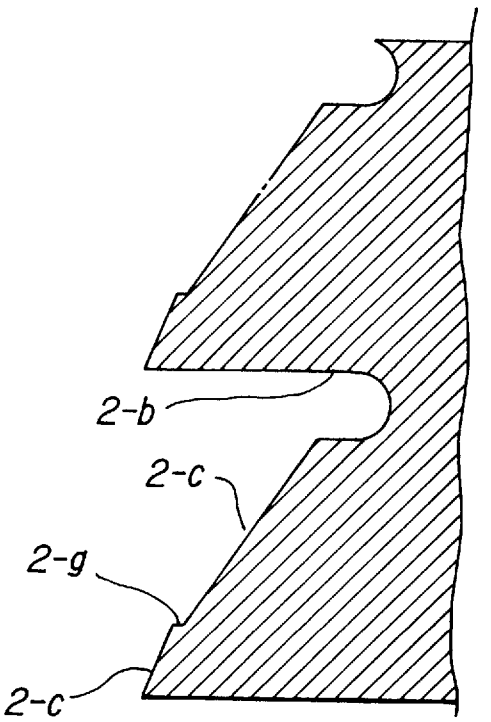
Figure 8B:
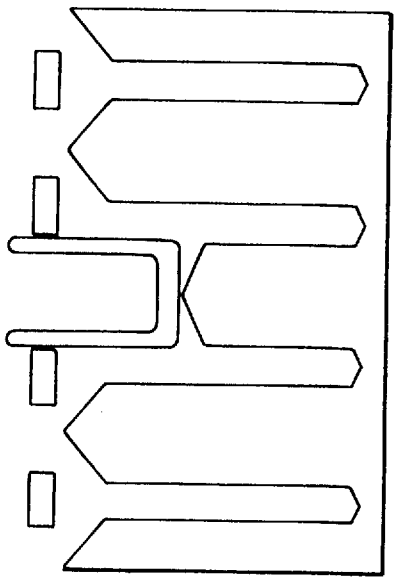
Figure 9:
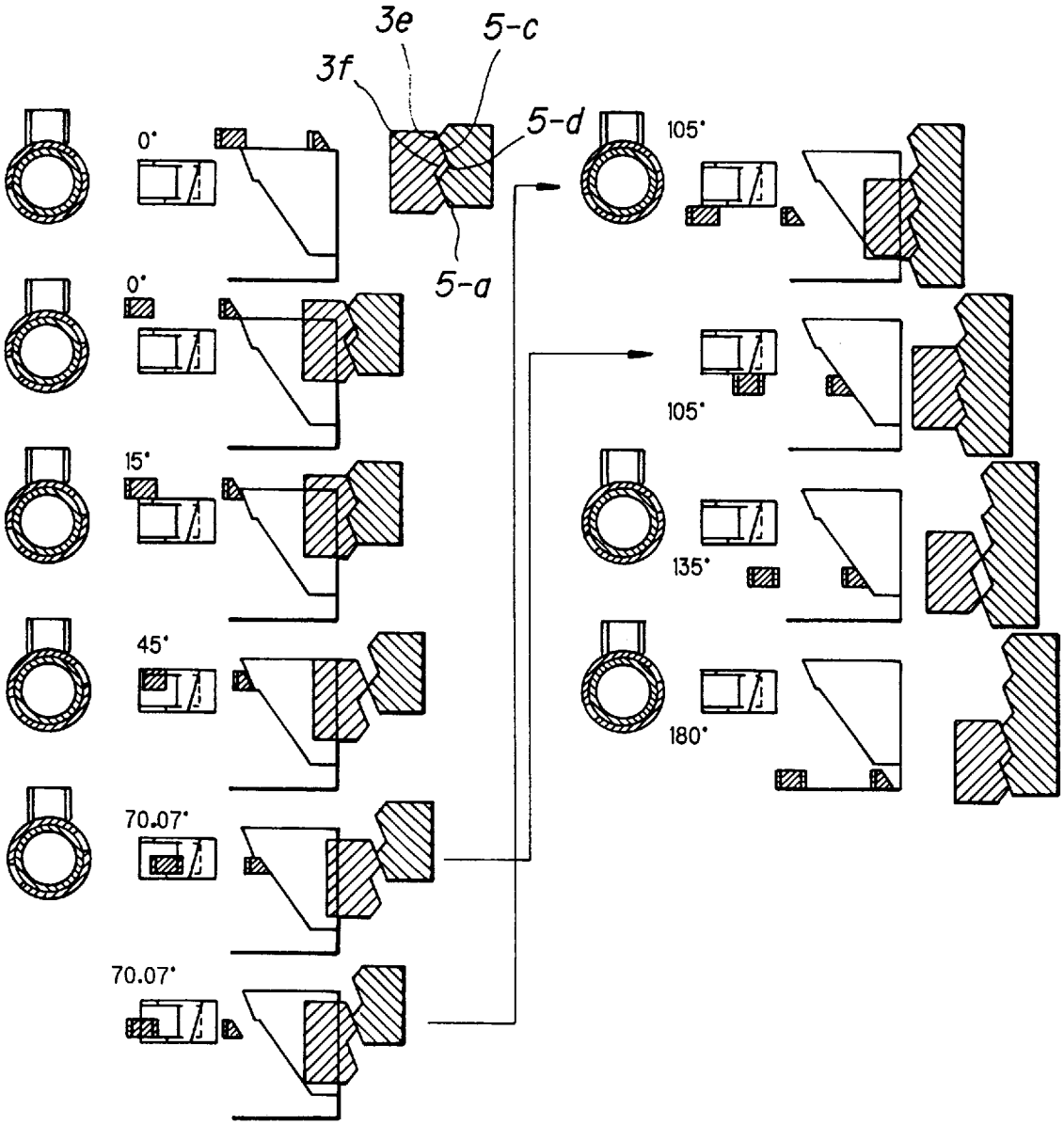
FIG. 9 schematically shows the operation of the cam inclined surface of the writing implement shown in FIG. 1A.
Figure 10:
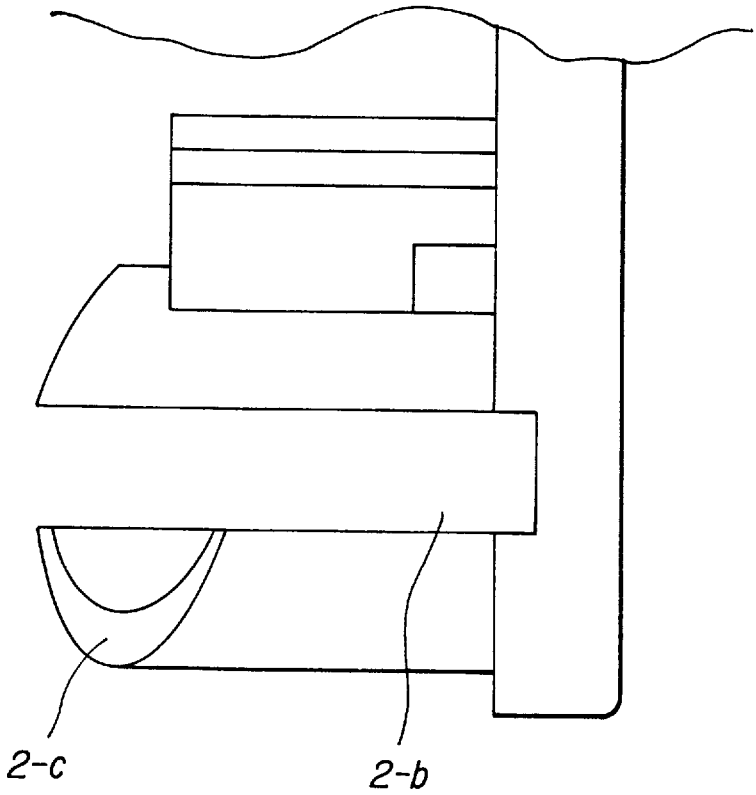
FIG. 10 shows the outer appearance of the cam portion of the components in the cylinder of the writing implement shown in FIG. 1B.
Figure 11:
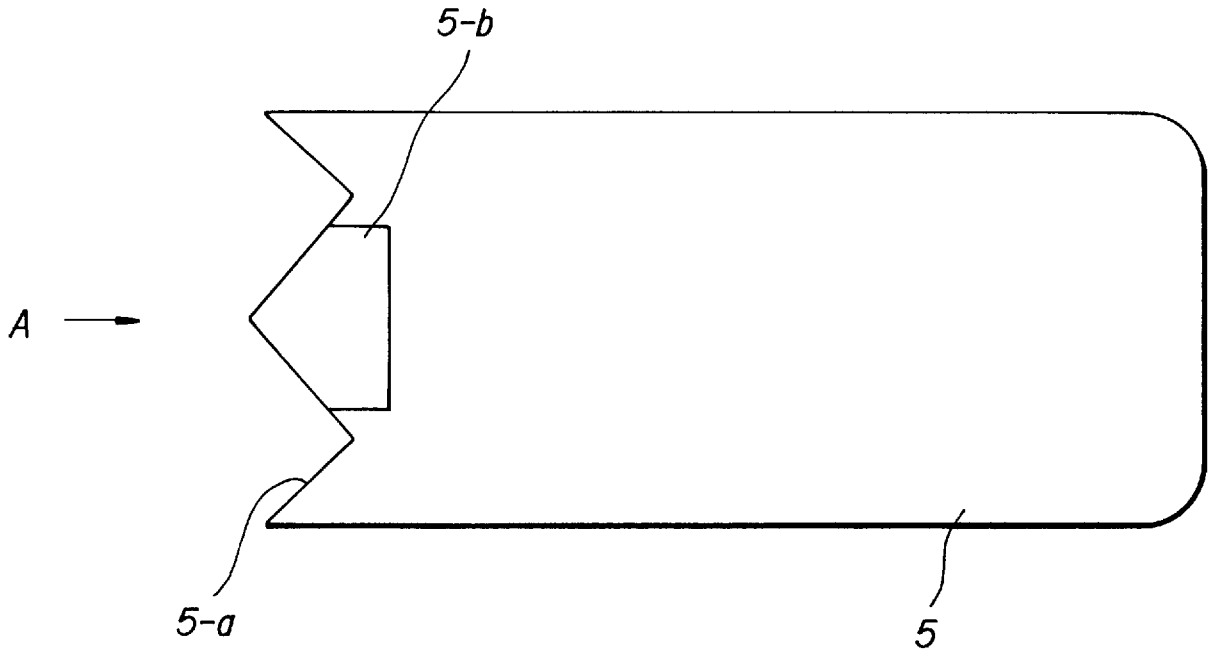
FIG. 11 is a longitudinal sectional view of the clicking rod component of the writing implement shown in FIG. 1B.
Figure 12:
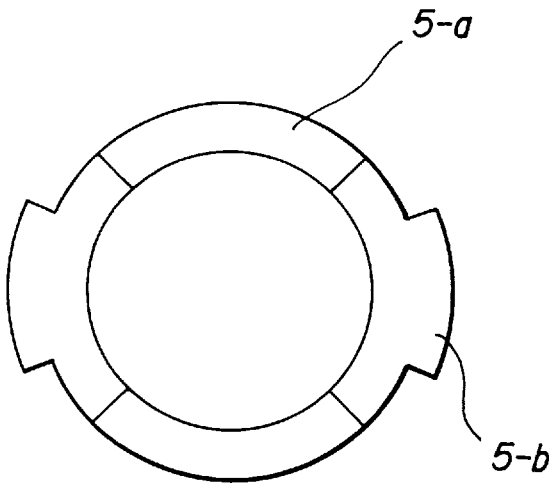
FIG. 12 is a cross-sectional view (seen from the direction of the arrow A) of the clicking rod component of the writing implement shown in FIG. 1B.
Figure 13A:
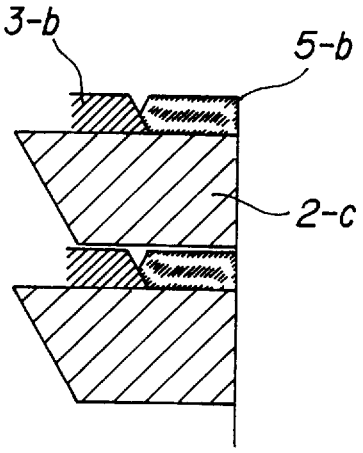
FIGS. 13A, 13B, 13C and 13D include schematic developments of the cam inclined surface of the writing implement shown in FIG. 1B.
Figure 13B:
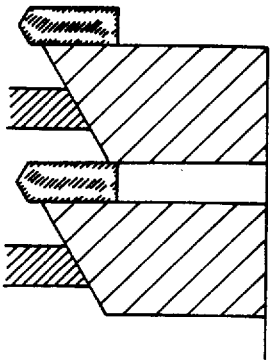
Figure 13C:
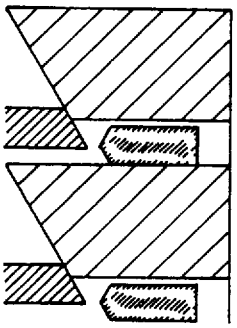
Figure 13D:
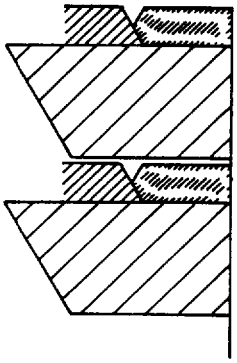

Embodiments shown in the accompanying drawings will be described in detail. FIGS. 1A to 13 show the embodiments of the present invention. This clicking-type writing implement incorporates a writing element which is filled up with medium-viscosity ball-point pen ink. As shown in FIGS. 1A to 13, in this writing element, ink 11 is stored in a transparent or translucent resin tube 10. A joint 12 is press-fitted in the distal end side of the writing element. A plug 7 is arranged in the rear end of the writing element. A ball valve seat having an ink introduction hole substantially at its center is provided in the writing element. A valve chamber is defined by the rear end of a tip 14 in the axial direction and the seat. During ordinary writing, the ink flows from the ink containing portion to a ball 14-*a* serving as the writing portion through a check ball 13 loosely fitted in the valve chamber. When the writing implement is set upright, the check ball 13 comes into tight contact with the seat, thereby preventing the back leaking of the ink 11.

The arrangement of this writing implement will be described. The clicking-type writing implement according to the present invention has a writing element having a writing portion at its distal end, a spring 6 for urging the writing element toward the end, and a clicking rod 5 interlocked with the writing element to project from a barrel cylinder 1. When the clicking rod 5 is depressed to project the writing element from the front portion of the barrel cylinder 1, the writing element is set in the projecting state. When an engaging bead 2-*a* of an inner cylinder 2 engages with an engaging rib 3-*a* of a rotor 3, this projecting state of the writing element is maintained. Reference number 2-*e* denotes the upright portion of a clip. The rotor 3 is interposed between the clicking rod 5 and the writing element in front of the clicking rod 5. The clicking rod 5 and the rotor 3 respectively have a clicking rod cam 5-*a* and a clicking cam 3-*c* forming cam inclined surfaces corresponding to each other. When the clicking rod 5 is clicked forward in the axial direction, the rotor 3 is pitch-rotated through a predetermined angle in only a predetermined direction. In the drawings, reference symbol 3-*d*1 denotes an ink passage; and 3-*d*2, an inserting portion. In this manner, the writing implement of the present invention has a double clicking mechanism. In the inner cylinder 2, a cam 2-*c* is formed at the front edge of a cylindrical portion 2-I inserted and fixed in the barrel cylinder 1. No cam surfaces are formed on the inner surface of the barrel cylinder 1. For the purpose of projecting and retracting the writing element, the rotor 3 has a cam projection 3-*b* that moves or rotates with the cam 2-*c* of the inner cylinder 2.

After the clicking rod 5 is clicked, if further depression of the clicking rod 5 is stopped, the writing element is constantly urged toward the end by the spring 6 and the rotor 3 is rotated by its cam projection 3-*b* and the corresponding cam 2-*c* of the inner cylinder 2 in the same direction as in the prescribed rotation which is caused by the clicking rod 5 and the rotor 3. In other words, the rotor 3 repeats the operation of rotating for a predetermined angle to achieve one rotation at a certain instance (upon two clicking operations in this embodiment).

Regarding the respective cam inclined surfaces required for these operations, their shapes and angles are selected as required. The shapes of a rotation stopper 5-*b* of the clicking rod 5, a rotation stopper constituted by a guide groove 2-*b* or a rotation stopper groove 2-*d*1 of the inner cylinder 2, a rest 2-*d*2 serving as the stopper at the rear portion of the shaft, and the like can be selected as required. Furthermore, in order to ensure these operations, a step 2-*g* not engageable with the cam projection 3-*b* is formed on the cam surface of the cam 2-*c* of the inner cylinder 2 described above, and a bead flat portion 2-*h* and a shaft horizontal portion 1-*d* are respectively formed on the engaging bead 2-*a* and a window 1-*a* of the barrel cylinder 1 to improve the reliability in operation.

In the present invention, the clicking rod cam 5-*a* and the clicking cam 3-*c* may be formed as combinations of acute and obtuse angles (5-*c,* 5-*d,* 3-*f,* and 3-*e*).

In order to perform assembly at a low cost or to omit components, if the backward movement of the inner mechanism of the shaft is regulated by engagement of a projection 2-*f* integrally formed with the inner cylinder 2 and a stopper groove 1-*c* of the barrel cylinder 1, the assembly can be achieved merely by insertion in a snap fit manner, so that a low-cost, slim, good-appearance clicking-type writing implement eliminating a mouthpiece 17 can be obtained. If the barrel cylinder 1 is made transparent, the mechanical movement of the cam surfaces and the inner cylinders can be visually observed.

A direct-supply writing element storing medium-viscosity ink tends to be subject to a problem especially upon application of an impact during the storing operation. The writing element stores medium-viscosity ink 11 having a viscosity of 10 mPa.S to 3,000 mPa.S [preferably having a viscosity of 30 to 1,000 mPa.S and so-called thixotropic properties or pseudoplasticity] when the shear rate at 25° C. is 200 ($s^{-1}$). Incorporated in the rear portion of the writing element is a low-volatile grease-type follower 9 and a follower rod 8 having a specific weight substantially equal to that of the follower 9. A tip 14 holds a writing ball 14-*a* and serves as the writing portion. The writing ball 14-*a* is prevented from coming off with a circumferential caulking portion 14-*b*. A tip spring 15 for constantly urging the writing ball 14-*a* is incorporated. The circumferential caulking portion 14-*b* and the writing ball 14-*a* constitute a ball valve mechanism. A backward leakage preventive mechanism having a valve structure constituted by a check ball 13 and a joint 12 is added in order to prevent backward leakage. A hot-melt type tip sealing compound 16 which melts at a temperature of 80° C. to 150° C. is attached to the distal end of the writing portion to prevent problems that may be caused during transportation. The grease-type follower 9 provided in the rear portion of the writing element is obtained by mixing a viscosity controlling agent with low-volatile materials such as, polybutene or a mineral oil, e.g., liquid paraffin. The follower rod 8 is made of a resin, e.g., PP or PE, with a specific weight substantially equal to that of the follower 9 so that it floats in the follower 9. In the tip 14 for holding the writing ball 14-*a* serving as the writing portion, the writing ball 14-*a* is prevented from coming off by the circumferential caulking portion 14-*b*. The tip spring 15 comprising a straight portion 15-*a* and a spring portion 15-*b* is incorporated to press with a load of about 1 g to 40 g. The writing ball 14-*a* together with the circumferential caulking portion 14-*b,* which serves as a sealing surface for the writing ball 14-*a,* form a ball valve mechanism to increase the impact resistance and prevent volatilization and backward leakage of ink. In order to directly press a very small writing ball 14-*a* usually having a diameter of 0.3 to 1.2 mm, the tip spring 15 is usually formed as a spring having a straight portion integrally formed at its distal end portion. In order to prevent this tip spring 15 from coming off, the rear end portion of the tip 14 is caulked. Also, the tube 10 serving as a ink-containing portion may be formed transparent or translucent, and the follower 9 may also be formed transparent or translucent, so that the color and remaining amount of the ink can be confirmed.

The operation of the clicking-type writing implement according to the present invention, which has the above arrangement, will be describe. More specifically, the clicking-type writing implement of the present invention has a writing element having a writing portion at its distal end, the spring 6 for urging the writing element toward the end, and the clicking rod 5 abutting against the rear end face of the writing element to project from the barrel cylinder 1. When the clicking rod 5 is depressed to project the writing element form the front portion of the barrel cylinder 1, the writing element is set in the projecting state. At this time, the engaging bead 2-*a* of the inner cylinder 2 engages with the engaging rib 3-*a* of the rotor 3 in the barrel cylinder 1 to maintain the projecting state. The rotor 3 is provided between the clicking rod 5 and the writing element in front of the clicking rod 5. The rotor 3 and the clicking rod 5, which has a rotation stopper with respect to the inner cylinder 2, are loosely fitted as required so that they are interlocked with the writing element by a clicking operation. The backward movement of the rotor 3 and clicking rod 5 is limited by the rest of the inner cylinder 2, so that the rotor 3 and clicking rod 5 can operate within only a predetermined clicking stroke.

The clicking rod 5 and rotor 3 respectively have the clicking rod cam 5-*a* and the clicking cam 3-*c* serving as corresponding cam inclined surfaces, and are formed such that the rotor 3 is pitch-rotated for a predetermined angle in only a predetermined direction by the forward clicking operation in the axial direction. After the clicking operation, when depression is stopped, the writing element is constantly urged toward the end by the spring 6, and is rotated by the cam projection 3-*b* of the rotor 3 and the corresponding cam 2-*c* of the inner cylinder 2 in the same direction as in the prescribed rotation caused by the clicking rod 5 and rotor 3. In other words, the rotor 3 repeats the operation of rotating for a predetermined angle to achieve one rotation at a certain instance (upon two clicking operations in this embodiment). Regarding the cam 2-*c* of the inner cylinder 2 necessary for these operations, the cam inclined surface of the cam 2-*c* is formed to be exposed on the front edge of the cylindrical portion 2-I inserted in the barrel cylinder 1. Therefore, the shaft diameter can be made smaller than that of the conventional shaft, and the cam surface can be visually observed from the outside. While the writing element projects, the cam 2-*c* of the inner cylinder 2 and the cam projection 3-*b* of the rotor 3 do not engage with each other (while they engage with each other in an ordinary Kahn-type ball-point pent), and an engaging projection or rib 3-*a* formed on the rotor 3 engages with the engaging bead 2-*a* of the clip portion integrally formed with the inner cylinder 2.

In the present invention, regarding the respective cam inclined surfaces required for these operations, their shapes and angles are selected as required. The shapes of the rotation stopper 5-*b* of the clicking rod 5, the rotation stopper constituted by the guide groove 2-*b* of the inner cylinder 2, the rest 2-*d*2 serving as the stopper at the rear portion of the shaft, and the like can be selected as required. Furthermore, in the present invention, in order to further ensure the operation, the step 2-*g* is formed on the portion where the engaging bead 2-*a* of the cam inclined surface and the engaging rib 3-*a* engage with each other. In the clicking operation for achieving engagement, the engaging rib 3-*a* is moved forward of the engaging bead 2-*a*. When depression of the clicking rod 5 is stopped to achieve engagement, the stepped portion of the cam prevents the cam from interfering with engagement. Usually, the engaging bead 2-*a* has sufficient spring properties that it is always urged inward in the radial direction of the shaft. A flat portion 2-*h* provided on the engaging bead 2-*a* engages a shaft horizontal portion 1-*d* formed on the window 1-*a* of the shaft, the flat portion 2-*h* and shaft horizontal portion 1-*d,* respectively, serving as stopper surfaces that limit radial inward movement of the engaging bead into the barrel cylinder. This configuration provides a clicking and engaging mechanism having improved function even if the respective members vary more or less.

In the present invention, in order to further ensure the operation, the cam surface of the clicking rod 5 and the cam surface of the clicking cam of the rotor 3 are formed as obtuse-angle cams (5-*c* and 3-*e*) and acute-angle cams (5-*d* and 3-*f*) which are more acute than the former. In the Kahn-type writing implement of the present invention, in order to constitute the safety mechanism, the larger the rotation of the rotor 3 caused by Kahn clicking, the better. By combination of these cams, the stability for the subsequent releasing operation can be increased while ensuring the contact area during clicking. As a consequence, an improved clicking and engaging mechanism is provided even if the respective members vary more or less.

The present invention has the above arrangement. Therefore, while the writing element projects, if the user forgets to retract the writing element and tries to put the writing implement in the pocket, the engaging bead 2-*a* of the inner cylinder 2 is lifted upward, and the engaging rib 3-*a* of the rotor 3 and the engaging bead 2-*a* of the inner cylinder 2 are separated and disengaged from each other, so that the writing element is moved in the retracting direction. The rotor 3 is moved backward, while rotating, by the cam projection 3-*b* of the rotor 3 and the cam 2-*c* of the inner cylinder 2, to the backward regulating position which is on the rear side in the axial direction, so that the writing element interlocked with the rotor 3 is retracted. At this time, the rotor 3 is set at the same position in the rotating direction as in the initial state. When the clicking rod 5 is depressed again, a writing element operation in the projecting direction can be started.

If the fixed projection 2-*f* is provided to the inner cylinder 2 by monolithic molding or press fitting, and the incorporated components, e.g., the inner cylinder 2, the clicking rod 5, the rotor 3, the writing element, and like are attached such that their backward movement is regulated by the projection 2-*f* and the stopper groove 1-*c* of the barrel cylinder 1, then the writing implement can be assembled merely by insertion in the snap fit manner, and the user can remove the mechanism portion and the writing element by pushing the projection 2-*f* with a sharp projecting object, thus enabling writing element exchange. Hence, an inexpensive product eliminating mouthpiece 17 can also be developed.

According to other embodiments of the present invention, the arrangement of the present invention can be applied not only to an ordinary clicking-type ball-point pen but also a writing implement which may stain the pocket when its writing portion is exposed. In addition to the writing implements described above, the present invention can be employed in writing implements having a variety of writing elements, such as, for example, a water-soluble ball-point pen which employs ordinary water-soluble ink and an ink occlusion member using tampon of fiber bundles, an oil-based ball-point pen which employs oil-based ink having a viscosity slightly lower than ordinary ink, a clicking-type writing implement, e.g., a marking pen or a marker which employs a writing element, that utilizes a fiber bundle as its pen tip or capillarity in its inner portion, a writing implement in which a metal leaf spring 4 is added to the inner cylinder 2 in order to further reinforce the spring properties of the clip portion of the inner cylinder 2. Even in these embodiments, the same effect as that of the present invention can be expected.

The operation of the present invention will be described by way of the above embodiments. In the clicking-type ball-point pen which is allowed to write when the clicking rod 5 projecting toward the end in the axial direction is depressed to project the writing element serving as the writing member from the tip of the shaft, the projecting state of the writing element is maintained through engagement of the engaging bead 2-*a* of the inner cylinder 2 and the engaging rib 3-*a*. When the engaging bead 2-*a* of the inner cylinder 2 is lifted, the engagement is canceled, and the writing element is automatically retracted. Accordingly, even if the writing implement is put in the pocket with the pen tip being exposed, the user's clothes can be prevented from being stained. Since the depressing force for the clip portion can be set to be smaller than in the conventional writing implement, the operational touch can be improved. Since the engaging projection does not project to outside the shaft, the writing implement can be easily put in and taken out from the pocket. In addition, the clip portion of the inner cylinder 2 can be prevented from creeping. Even if the clip portion of the inner cylinder 2 creeps, as the inner cylinder 2 operates easily with a rotational motion, functional problems are avoided. Even with a slightly thick writing element, a slim writing implement can be formed. When the shaft is transparent, the operation can be visually observed, providing a unique mechanical outer appearance. Since variations in engaging position are absorbed by the step 2-*g* of the cam inclined surface and the flat portions of the window 1-*a* and engaging bead 2-*a,* the reliability of engagement is improved. Since any positional variations are absorbed by the combination of the acute-angle surfaces 5-*d* and 3-*f* and the obtuse-angle surfaces 5-*c* and 3-*e* of the clicking rod 5 and the rotor 3, the reliability of the clicking operation and engaging operation is improved. Furthermore, since the projecting and retracting operations are repeated by only operating the clicking rod 5, no special explanation is required for the user, thus improving the operability. Moreover, the impact upon returning is converted into a rotational force by the cam inclined surfaces and is weakened to a great extent since the clicking rod 5 is in contact with the user's finger. Therefore, a writing implement with medium-viscosity ink which cannot be used in conventional writing implements can be used in a writing implement having the mechanism of the present invention.

The arrangement and operation of the clicking-type writing implement of the present invention are as described above. An easy-to-use writing implement can be provided which not only satisfies requirements for the functions of a high-safety clicking-type writing implement free from a serious defect, e.g., staining clothes, but also can be used easily by the user. Moreover, the adverse influence of the creep phenomenon of the clip can be decreased. Even if the creep phenomenon should occur, since the inner cylinder operates easily with a rotational motion, no functional problems arise. The arrangement of the components can be simplified, and an expensive resin having a high heat resistance need not be selected. Consequently, an inexpensive, highly functional, highly durable, stable product can be provided. In addition, a low-cost, satisfactory clicking-type writing implement, which can be put in and taken out of the pocket smoothly and allows a clicking operation with a good operational feel can be provide.

What is claimed is:

1. A writing implement comprising:

a barrel cylinder, said barrel cylinder having a front end, a rear end, and a longitudinal axis extending from said front end to said rear end;

a writing element in said barrel cylinder, said writing element having a writing portion proximal to said front end of said barrel cylinder;

a spring for urging said writing element toward said rear end of said barrel cylinder;

a clicking rod loosely engaging said writing element proximal to said rear end of said barrel cylinder, a portion of said clicking rod projecting from said rear end of said barrel cylinder; and a double clicking mechanism connecting said barrel cylinder and said clicking rod, the double clicking mechanism comprising:

an inner cylinder having a cylindrical portion and a clip, said cylindrical portion adapted to slide axially into said rear end of said barrel cylinder and be secured in said rear end of said barrel cylinder, said cylindrical portion having a front edge, a portion of said front edge inclined along said longitudinal axis to form a cam, said clip positioned externally of said barrel cylinder, adjacent an external surface of said barrel cylinder, said clip extending along said longitudinal axis of said barrel cylinder; and a rotor having a cam projection, said cam projection slidably engaging said cam of said front edge of said cylindrical portion of said inner cylinder, slidable movement of the cam projection on the cam in response to movement of the clicking rod thereby causing said writing portion of said writing element to project and retract from said front end of said barrel cylinder.

2. The writing implement according to claim 1 further comprising a safety mechanism, said safety mechanism comprising an engaging bead on said clip, said engaging bead extending radially inwardly through a window in said barrel cylinder, and an engaging rib extending outwardly from said rotor, said engaging bead cooperatively aligned to engage said engaging rib when said writing portion of said writing element is projected from said barrel cylinder.

3. The writing implement according to claim 2 wherein said cam of said cylindrical portion of said inner cylinder has a cam surface, said cam surface has a step, said step permitting said cam projection to disengage from said cam when said engaging bead and said engaging rib are engaged.

4. The writing implement according to claim 3 wherein said cam of said inner cylinder and a clicking rod cam are arranged so as to each have a cam surface as a combination of an acute-angle surface and an obtuse-angle surface.

5. The writing implement according to claim 1 further comprising a safety mechanism, said safety mechanism comprising an engaging bead on said clip, said clip connected to said cylindrical portion of said inner cylinder, said clip flexible outwardly from said barrel cylinder in a radial direction, said clip biased such that said engaging bead engages an engaging rib on said rotor when said writing portion of said writing element is projected from said barrel cylinder, and such that said cam projection of said rotor does not engage with said cam of said inner cylinder while said writing portion of said writing element projects from said barrel cylinder.

6. The writing implement according to claim 1 wherein a projection of said inner cylinder engages with a stopper groove of said barrel cylinder to secure said writing element, said inner cylinder, and said rotor in said barrel cylinder.

7. The writing implement according to claim 1 wherein said inner cylinder is integrally formed with a projection having a beam portion flexible in a radial direction, said projection being prevented from longitudinally moving in an axial direction upon engagement with a stopper groove in said barrel cylinder, and said projection having an upright portion, said upright portion engaging a guide groove to prevent rotation of said inner cylinder in said barrel cylinder.

8. The writing implement according to claim 2 wherein said engaging rib of said rotor does not extend beyond an outer diameter of said barrel cylinder, the writing implement further comprising a bead flat portion on said engaging bead and a shaft flat portion on said window in said cylinder, said bead flat portion and said window flat portion engaging to prevent said engaging bead from extending into said barrel cylinder beyond a predetermined point.

9. The writing implement according to claim 1 wherein said barrel cylinder is made of a transparent resin, so that said cam of said inner cylinder and said rotor are visible from outside the barrel cylinder.

* * * * *